US007036258B1

(12) United States Patent
Lee et al.

(10) Patent No.: US 7,036,258 B1
(45) Date of Patent: May 2, 2006

(54) PASSIVE SAFETY BLOCK

(76) Inventors: Lanny Ray Lee, 5090 N. US Highway 1, Melbourne, FL (US) 32940; Brian Eric Lee, 437 Hannon Ave., Monterey, CA (US) 93950

( * ) Notice: Subject to any disclaimer, the term of this patent is extended or adjusted under 35 U.S.C. 154(b) by 73 days.

(21) Appl. No.: 10/638,718

(22) Filed: Aug. 11, 2003

Related U.S. Application Data

(63) Continuation-in-part of application No. 10/205,651, filed on Jul. 25, 2002, now abandoned.

(51) Int. Cl.
*F41A 17/22* (2006.01)

(52) U.S. Cl. ..... 42/70.06; 42/70.07; 42/70.11

(58) Field of Classification Search ..... 42/70.07, 42/70.11, 70.06, 70.01
See application file for complete search history.

(56) References Cited

U.S. PATENT DOCUMENTS

| | | | | | |
|---|---|---|---|---|---|
| 989,817 | A * | 4/1911 | Siegel | 42/70.06 |
| 1,227,531 | A * | 5/1917 | Donadio | |
| 2,453,683 | A * | 11/1948 | Caldow | 42/70.06 |
| 2,503,953 | A | 4/1950 | Lind | 42/70 |
| 2,505,227 | A | 4/1950 | Charters | 42/70 |
| 2,945,316 | A | 7/1960 | Mulno | 42/66 |
| 3,066,433 | A | 12/1962 | Rogers et al. | 42/70 |
| D196,842 | S | 11/1963 | Schaefer | |
| 3,139,694 | A | 7/1964 | Schaefer | 42/70 |
| 3,188,764 | A * | 6/1965 | Harding | 42/69.01 |
| 3,352,047 | A | 11/1967 | McDonnell | 42/70 |
| 3,616,559 | A | 11/1971 | Sobolewski | 42/1 |
| 3,673,725 | A | 7/1972 | Cravener | 42/1 |
| 3,979,850 | A * | 9/1976 | Schiessl et al. | 42/70.06 |
| 4,628,626 | A | 12/1986 | Brandt | 42/70.1 |
| 4,825,576 | A | 5/1989 | Troncoso et al. | 42/70.07 |
| 4,972,618 | A | 11/1990 | Justice, Sr. et al. | 42/70.11 |
| 5,012,605 | A | 5/1991 | Nishioka | 42/70.07 |
| 5,042,185 | A | 8/1991 | Justice, Sr. | 42/70.11 |
| 5,125,178 | A | 6/1992 | Justice | 42/70.11 |
| 5,927,578 | A | 7/1999 | Kay | 224/244 |
| 6,032,396 | A | 3/2000 | Shapiro | 42/70.06 |
| 6,173,518 | B1 * | 1/2001 | Oberst | 42/70.06 |
| 6,212,812 | B1 * | 4/2001 | Aigner | 42/70.06 |
| 6,223,460 | B1 * | 5/2001 | Schmitter et al. | 42/70.06 |
| 6,301,816 | B1 | 10/2001 | Saltz | 42/70.06 |
| 6,519,888 | B1 * | 2/2003 | Oberst | 42/70.06 |
| 6,553,706 | B1 * | 4/2003 | Gancarz et al. | 42/70.01 |
| 6,615,529 | B1 * | 9/2003 | Seecamp | 42/70.06 |
| 6,629,379 | B1 * | 10/2003 | Doiron | 42/70.06 |
| 6,843,013 | B1 * | 1/2005 | Cutini et al. | 42/70.06 |
| 6,880,281 | B1 * | 4/2005 | Orr | 42/70.01 |
| 2003/0213159 | A1 * | 11/2003 | Cutini et al. | 42/70.06 |

* cited by examiner

*Primary Examiner*—Stephen M. Johnson
(74) *Attorney, Agent, or Firm*—Brian S. Steinberger; Law Offices of Brian S. Steinberger, P.A.

(57) ABSTRACT

Firearm safety block devices and methods of use increase the pressured needed to pull back on triggers to cause a firearm to discharge the first shot A block member can be mounted on the firearm at different locations such as above, inside the trigger and behind the trigger. The invention can provide different block members having frangible areas that are broken or bent at selected side imposed pressures. Breaking, shearing or bending the block members is required to operate the firing mechanism as needed to cause the firearm to discharge. A spent frangible block member can be removed and replaced. When the firearm safety block is not applicable the block member can be removed.

11 Claims, 4 Drawing Sheets

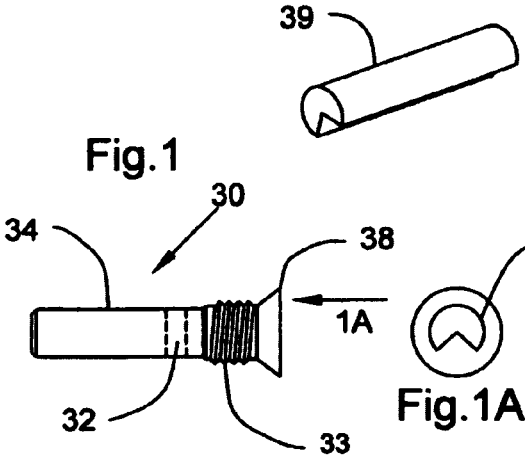
Fig.1
Fig.1A
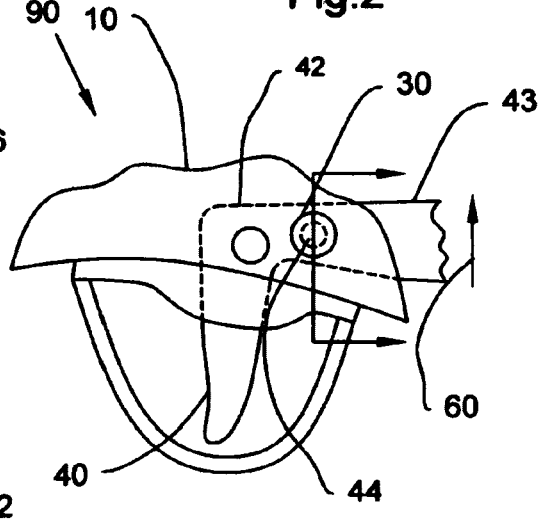
Fig.2
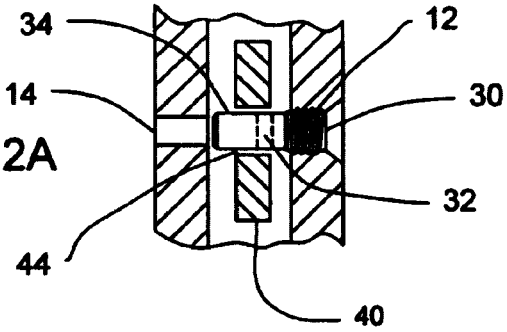
Fig.2A
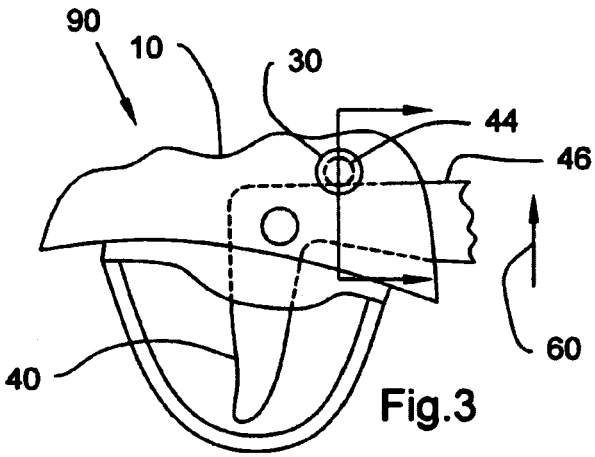
Fig.3
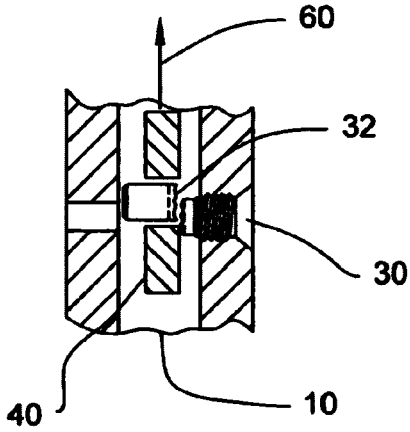
Fig.2B Fig.3A
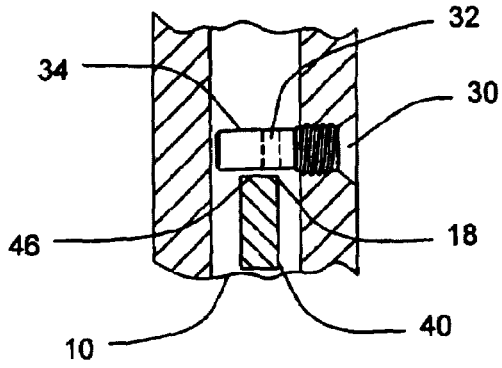
Fig.3B
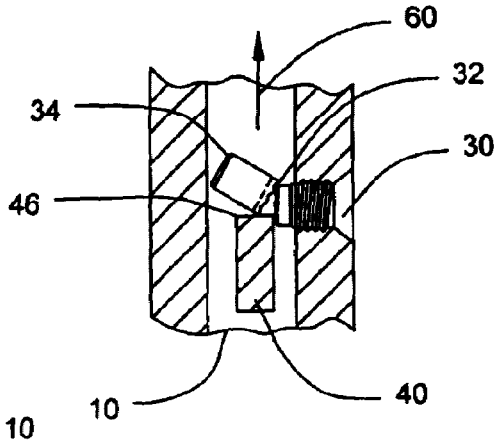
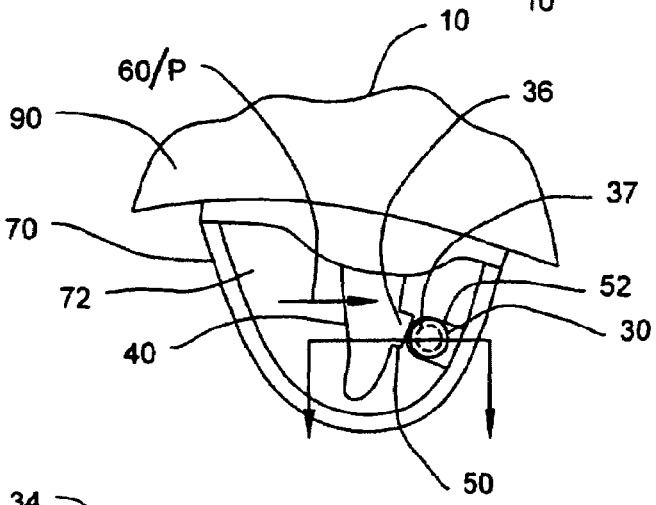
Fig.4
Fig.4B
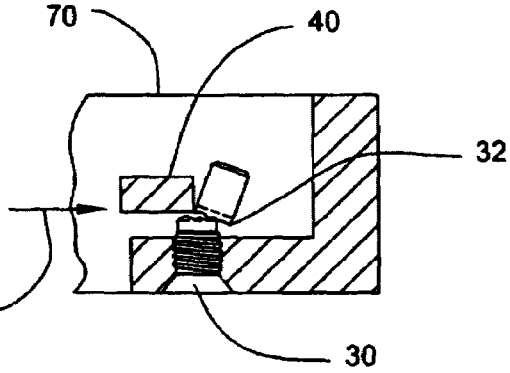
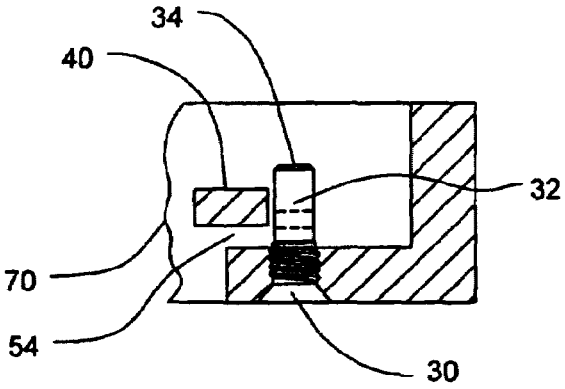
Fig.4A

PASSIVE SAFETY BLOCK

This invention is a Continuation-In-Part of U.S. patent application Ser. No. 10/205,651 filed Jul. 25, 2002, now abandoned.

FIELD OF THE INVENTION

This invention relates to safety devices for firearms, and in particular to methods and apparatus for using a passive trigger locking mechanism that requires selected pressure to break or bend open in order to operate the firearm so that the firearm remains immediately useable for adults and not for children.

BACKGROUND AND PRIOR ART

Thousands of accidental deaths and injuries occur every year from the use of firearms by both experienced adult handlers and children. It is essential that firearms be locked away or kept in a locked state when the firearms are being used for personal protection in households where children and visitors can be present. Generally, the locks available for firearm protection include those that use a key. In order to keep the firearm in an accessible state, the key must be kept usually in a hidden, but readily available location. Often this hidden location is a place that can be discovered by curious children which unfortunately is the setting for the disaster that is repeated thousands of times annually.

Firearms are often accidentally discharged by rough handling or by being dropped while being moved. Experienced and trained users while under stressful situation discharge their firearms hastily only when there is only a perceived need for extreme force.

Various proposals have occurred over the years for locking triggers. See for example, U.S. Pat. No. 2,503,953 to Lind; U.S. Pat. No. 2,505,227 to Charters; U.S. Pat. No. 2,945,316 to Mulno; U.S. Pat. No. 3,066,433 to Rogers et al.; U.S. Pat. No. 3,139,694 to Schaefer; U.S. Pat. No. 3,352,047 to McDonnell, U.S. Pat. No. 3,616,559 to Soblewski; U.S. Pat. No. 3,673,725 to Cravener; U.S. Pat. No. 4,628,626 to Brandt; U.S. Pat. No. 4,825,576 to Troncoso et al.; U.S. Pat. No. 4,972,618 to Justice, Sr. et al.; U.S. Pat. No. 5,012,605 to Nishioka; U.S. Pat. No. 5,042,185 to Justice, Sr.; U.S. Pat. No. 5,125,178 to Justice; U.S. Pat. No. 5,927,578 to Kay; U.S. Pat. No. 6,032,396 to Shapiro; U.S. Pat. No. 6,301,816 to Saltz; Des. No. 196,842 to Schaefer; However, these references are limited to only locking the firearm triggers and the like, and preventing the firearms from being used while the locks are in place. Users of these lock devices would have physically remove portions of the lock to operate the firearm, which takes extra time and effort.

New firearms are being produced today that allow for increasing the finger pressure needed to fire the firearm. However, these firearms must be initially manufactured with modified triggers for adjusting finger pressure, and also do not intended to break apart when a pressure is exceeded. Existing firearms cannot be retrofitted.

This invention is not intended to solely replace gun and trigger locks, but it is to provide an additional and/or last defense against accidental discharge of the firearm. The invention is to make a firearm unusable by children.

SUMMARY OF THE INVENTION

A primary objective of the invention is to provide a passive safety mechanism for firearms that does not require the user to have to disassemble in order to operate the firearm.

A secondary objective of the invention is provide a passive safety mechanism for firearms that does not delay the operation of the firearm when used by adults.

A third objective of the invention is to provide a passive safety mechanism for firearms that can be easily retrofitted into existing firearms or built into new firearms.

A fourth objective of the invention is to provide a passive safety mechanism for firearms that can be easily removed and replaced as needed or desired.

A fifth objective of the invention is to provide a passive safety mechanism for firearms that reduces or eliminates the accidental discharge of the firearm.

A sixth objective of the invention is to provide a passive safety mechanism for firearms that requires selective excessive force pressure to use.

A seventh objective of the invention is to provide a passive safety mechanism for firearms that does not require a key or combination to use.

An eighth objective of the invention is to provide a passive safety mechanism for firearms that is intended to be replaced after each use.

A ninth objective of the invention is to provide a passive safety mechanism for firearms that renders the firearm unusable by most children but still operable by most adults.

An inexpensive, easy to assemble and use passive safety trigger block that can be both supplied by the firearm maker or added to firearms in service. Quick and easily remove and replace is yet another feature of invention. Safety is achieved by substantially increasing the amount of force necessary to pull the trigger the initially. Depending on needs, this force requirement would be increased from low pressure to such pressure that only a strong adult could pull the trigger. After the safety block is overcome the firearm will operate normally. The safety block is a block member blocking a firing mechanism and the trigger. The block member can be sheared and broken when a selected pressure has been reached. After which the block member is replaced for future applications. An alternative embodiment allows for the block member to become bent to thereby permitting operation of the firing mechanism. The selected amount force required to bend or shear the block member is reliably accomplished by its configuration and materials.

Further objects and advantages of this invention will be apparent from the following detailed description of the presently preferred embodiments which are illustrated schematically in the accompanying drawings.

BRIEF DESCRIPTION OF THE FIGURES

FIG. 1 is a side view of a block element, according to preferred embodiment of the present invention.

FIG. 1A is an end view of the block element of FIG. 1 along arrow 1A.

FIG. 2 is a left side view of a firearm having the safety block, according to a preferred embodiment of the present invention.

FIG. 2A is a cross-sectional view of a firearm having a safety block, according to a preferred embodiment of the present invention.

FIG. 2B is a cross-sectional view of a firearm having a safety block of FIGS. 2 and 2A in a post broken state.

FIG. 3 is a left side view of a firearm having a safety block, according to another preferred embodiment of the present invention;

FIG. 3A is a cross-sectional view of a firearm having a safety block, of FIG. 3.

FIG. 3B is a cross-sectional view of a firearm having a safety block of FIGS. 3 and 3A in a broken or bent state.

FIG. 4 is a left side front view of a firearm having a safety block, according to another preferred embodiment of the present invention.

FIG. 4A is a cross-sectional view of the firearm having a safety block of FIG. 4.

FIG. 4B is a cross-sectional view of the firearm having a safety block of FIGS. 4 and 4A in a broken or bent state.

DESCRIPTION OF THE PREFERRED EMBODIMENTS

Figure 5:
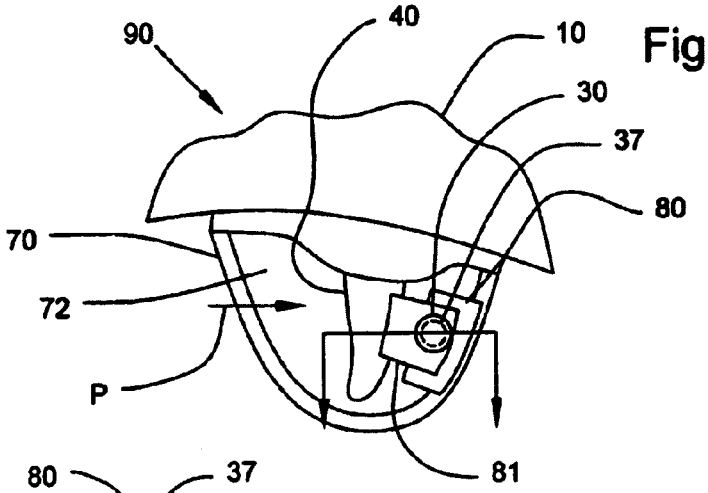
FIG. 5 is a left side view of a firearm having the safety block, according to a preferred embodiment of the present invention.

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

The American Medical Association, Archives of Pediatrics and Adolescent Medicine, December 1995 issue reported that researchers have determined that approximately "92 percent" of firearms are known to have "trigger-pull settings of 10 pounds or less" and approximately "63 percent have a trigger pull setting of less than five pounds." The article went on to mention that "at least 85 percent of three to four year olds could fire a gun using two fingers with a trigger-pull setting of less than five pounds."

Thus, there is a need to have settings of at least approximately 5 to approximately 10 pounds, and preferably greater than approximately 10 pounds or more to restrict small children from firing a firearm. For older children, settings of approximately 15 pounds, approximately 20 pounds, approximately 25 pounds, approximately 30 pounds, or greater would also be helpful to restrict the child user from being able to pull a trigger to fire a firearm.

FIG. 1 represents a preferred embodiment of the safety block invention that has a block member 30 with a leading end 34 followed by the frangible section 32 then on to a external threads 33 finished with a cap head 38 preferably with a shaped opening 36 having torque features, the torque features can include a non-circular and non-conventional opening for allowing a user to insert the block member with a tool 39 having an end that mateably insertable into the shaped opening 36. FIG. 1A is an end view of the block element 30 of FIG. 1 along arrow 1A.

Figure 7A:
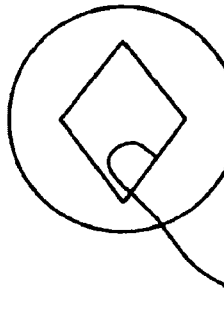
FIG. 7A shows the head cap end of the block member of FIG. 7.
Figure 7:
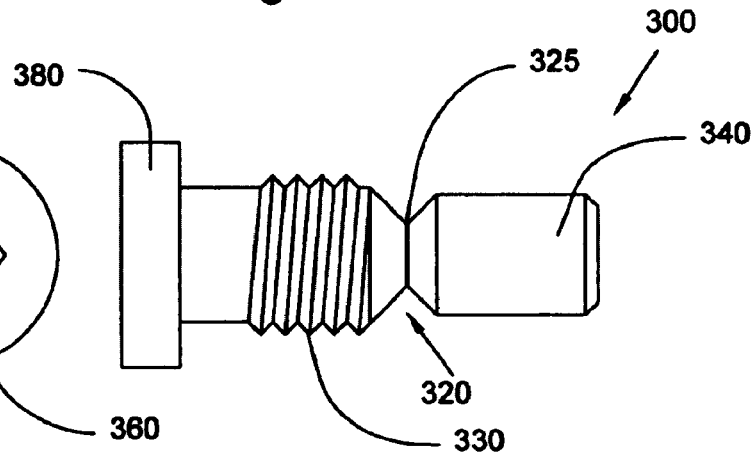
FIG. 7 shows a side view of another variation of a block member for use with the subject invention.

Referring to FIGS. 1 and 1A, the block member 30 can preferably have a cylindrical tubular shape and be formed from a solid material, a hollow material, and the like. The material can include a continuous material such as all metal, all aluminum, and the like. Alternatively, the material can be a continuous all plastic, all fiberglass, and the like. Additionally, the block member can be a combination of materials such as a metal longitudinal cylinder with the frangible section being plastic, and the like. Still furthermore, FIG. 7 shows another version of the block member.

As described below, when being used the block member 30 can break apart when a threshold shear pressure value against the frangible portion 32 has been reached. Alternatively, the block member 30 can bend. Table 1 shows a comparison of the estimated finger strengths of child and along with block member being a 1/16" or a 1/8" solid diameter shaped pin

TABLE 1

| average two finger strength child | average finger strength adult | Block member A shear pin 1/16" dia steel with groove | Block member B shear pin 1/8" dia acrylic with groove |
|---|---|---|---|
| 6 in/lbs | 25 in/lbs | 10 to 75 in/lbs | 8 to 50 |

First Embodiment

FIG. 2 shows the block member 30 located into the trigger 40 of a common firearm. The frame 10 of a conventional firearm has an extended L-shaped trigger 40 having pivotable about point 42 with a hole 44 by located orthogonal to the movement direction 60. FIG. 2A represents a cross-sectional view through frame 10 with trigger 40 in an open free position, with frame 10 having an internal threaded hole 12 aligned to hole opening 44. A block member 30 leading end 34 located in hole 44 can be screwed into internal thread hole 12 located in frame 10 which can have a clear hole 14. FIG. 2B is a cross-sectional view of FIGS. 2 and 2A showing the results of the trigger 40 of FIG. 2 being pulled in direction of arrow P with upper portion 43 of trigger 40 movement shown by arrow 60 thereby causing block member 30 to be bent or fractured at preferably at frangible section 32 whereby trigger safety is overcome.

Second Embodiment

FIG. 3 is another embodiment of locating the blocking member 30 above a trigger 40. Referring to FIG. 3 the present invention a safety block is represented in a common firearm 90 having a frame 10 with a block member 30 above an extended L-shaped trigger 40. Trigger 40 of the firearm can have an envelope portion 46 which can move upward in the direction of arrow 60. Frame 10 can have a hole opening 44 orthogonal to direction of trigger movement 60.

FIG. 3A is a cross-sectional view of frame 10 with block member 30 leading end by in near proximity 18 to an upper leading edge of the trigger envelope 46. A frangible section 32 can be attached to the frame 10 by fasteners 33 (shown in FIG. 1) and can be preferably positioned between trigger 40 and frame 10. The trigger 40 is shown in a free unused position in FIG. 3A.

FIG. 3B is another cross-sectional view of FIGS. 3 and 3A showing frame 10 with a block member 30 in a bent or broken state. Trigger 40 can be pulled in the direction of arrow P thereby moving leading edge 46 upward in the direction of arrow 60 thereby overcoming the safety block of the invention by bending or breaking a frangible section 32 and displacing leading end 34 of the blocking member.

Third Embodiment

FIG. 4 shows another embodiment of the present invention with the safety block invention behind a trigger 40 in a conventional handgun. Here, the novel safety block employed in a common firearm 90 having a frame 10 with a trigger guard 70 circumscribing a trigger area 70 with an extended trigger 40 dispersed therein. An extended trigger 40 can have a protrusion 50 with a surface 36 orthogonal to the movement 60 of the trigger. A trigger guard 70 can have a lug portion 52 with an internal threaded hole opening 37 aligned proximally to surface 36 when the trigger is in the free unused position. The block member 30 can be screwed into internal threaded hole 37.

FIG. 4A is a cross-sectional view of the trigger guard 70 showing the trigger 40 in the free position with a frangible section 32 of the block member 30 preferably being located in gap 54 between protrusion 50 and lug 52. The frangible section 32 is shown with the first end 34.

FIG. 4B shows another cross-sectional view of FIGS. 4 and 4A of a trigger guard 70 having a trigger 40 pulled in the direction of arrow P thereby breaking or bending the block member 30 preferably at the frangible section 32. When a selected pulling pressure is reached the passive firearm safety block is thereby overcome.

Fourth Embodiment

FIG. 5 shows another preferred embodiment of using the novel safety block as a retrofit attachment to a firearm. Here, the safety block invention is employed in a common firearm 90 having a frame 10 with a trigger guard 70 circumscribing a trigger area 72 with an extended trigger 40 dispersed therein. A stationary plate 80 with an internally threaded hole 37 located orthogonal to the movement 60 can be retained on a rear portion of trigger guard 70. A Moving plate 81 can be retained on the rear of the trigger 40 and has a hole opening 38 approximately aligned, with the trigger in free position, to internal threaded hole 37. Plate 81 can be clamped between head 31 of block member 30 and stationary plate 80.

Figure 5A:
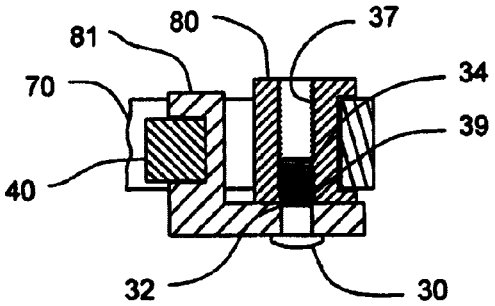
FIG. 5A is a cross-sectional view of the firearm with a safety block of FIG. 5.

FIG. 5A is an enlarged cross-sectional view of FIG. 5 showing trigger guard 70 showing trigger 40 in a free unused position with moving plate 81 and stationary plate 80 retained on the trigger guard 70. The external thread first end 34 of block member 30 can be screwed into internal threaded hole 37 and frangible section 32 can be located approximately at the joint area 39.

Figure 5B:
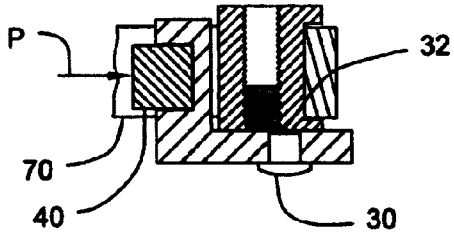
FIG. 5B is a cross-sectional view of the firearm having a safety block of FIGS. 5 and 5A in a broken or bent state.

FIG. 5B is another cross-sectional view of FIGS. 5 and 5A of the trigger guard 70 with trigger 40 pulled in the direction of arrow P. Frangible pin 30 is sheared or bent at frangible section 32 thereby overcoming the passive firearm safety block.

Fifth Embodiment

Figure 6:
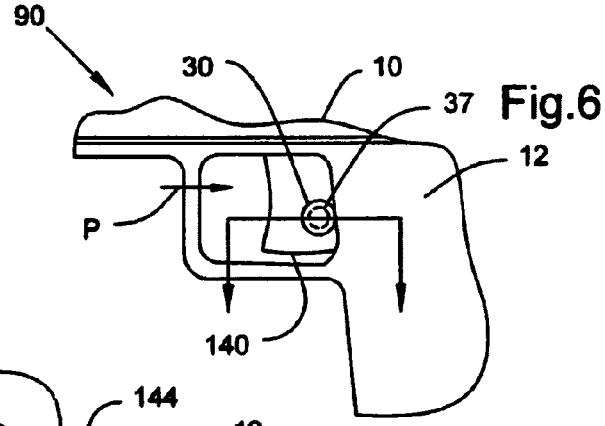
FIG. 6 is a left side view of a firearm having a safety block, according to another preferred embodiment of the present invention.

FIG. 6 represents the block member 30 of the present invention a safety block employed inside the lower trigger portion of a common firearm 90. Trigger 140 operates by sliding in slot 144 in front side of handle 12 extending from main frame 10. An internally threaded 37 hole somewhat orthogonal to the direction of movement 60 is located in close proximate to handle 12.

Figure 6A:
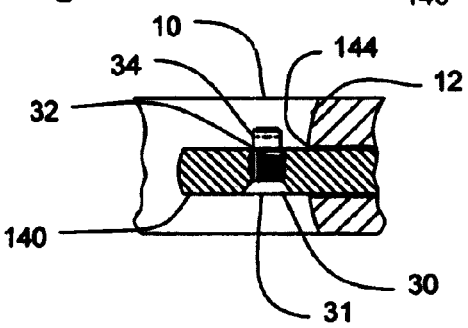
FIG. 6A is a cross-sectional view of the firearm having a safety block of FIG. 5.

FIG. 6A is a cross-sectional view of FIG. 6 showing trigger 40 located in slot 144 in handle 12. First end 34 is followed by a frangible section 32 of a block member 30 is extending from trigger 140. Head 31 can have a recess to permit entry into slot 144.

Figure 6B:
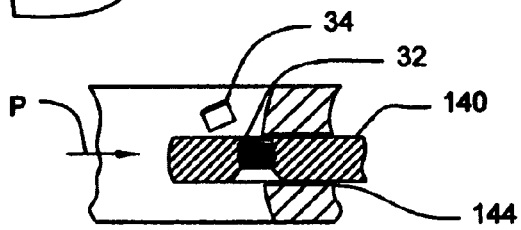
FIG. 6B is a cross-sectional view of the firearm having a safety block of FIGS. 5 and 5A in a broken or bent state.

FIG. 6B is another cross-sectional view of FIGS. 6 and 6A showing trigger 40 moved in slot 144 in the direction shown by arrow P. Thereby first end 34 impinges on handle 12 and is fractured to become broken or bent at preferably at frangible section 32 whereby passive firearm safety block is overcome.

Sixth Embodiment

FIG. 7 shows a side view of another variation of a block member 300 for use with the subject invention. FIG. 7A shows the head cap end of the block member of FIG. 7. Block member 300 can include a longitudinal cylindrical type body having a head cap end 380 with a selected shape opening 360 that can be shaped to accept a torque tool therein. Block member 300 can include a threaded side portion 330 and distal end portion 340 that can have smooth sides. Frangible portion 320 can be a grooved mid-section having a smaller diameter than the threaded portion 330 and the distal end portion 340. Block member 300 can be a stainless steel type body with shaft portions 330 and 340 having a minimum diameter of approximately 0.06 inches having a rating of 75,000 PSI (pounds per square inch). The diameter of the root portion 325 of the frangible portion 320 along with stress area in square inches, tension strength and shear strength in pounds per square inch is shown in TABLE 2.

TABLE 2

| Diameter in inches of Root V | Stress Area Square Inch | Tension Strength | Shear Strength |
|---|---|---|---|
| .032 | .0128 | 960 | 480 |
| .020 | .0013 | 94 | 47 |
| .015 | .0007 | 53 | 26.5 |
| .010 | .0003 | 23 | 11.5 |
| .009 | .00025 | 19 | 9.5 |
| .008 | .0002 | 15 | 7.5 |

Referring to Table 2, it would be preferable to break and not bend the V frangible portion 320 of the block member, and that 0.008 inch diameter and above would be preferable minimum diameters for the frangible portion of the block member 300.

While the block member 300 of FIGS. 7 and 7A and Table 2 are shown and described as being stainless steel. The block member 300 can be formed from other materials. For example, an aluminum 2024-T3 (rated at approximately 40,000 PSI) similar shaped block member for the same diameters listed in Table 2 would have stress area, tension strength and shear strength at approximately half the amounts for stainless steel.

Figure 8:
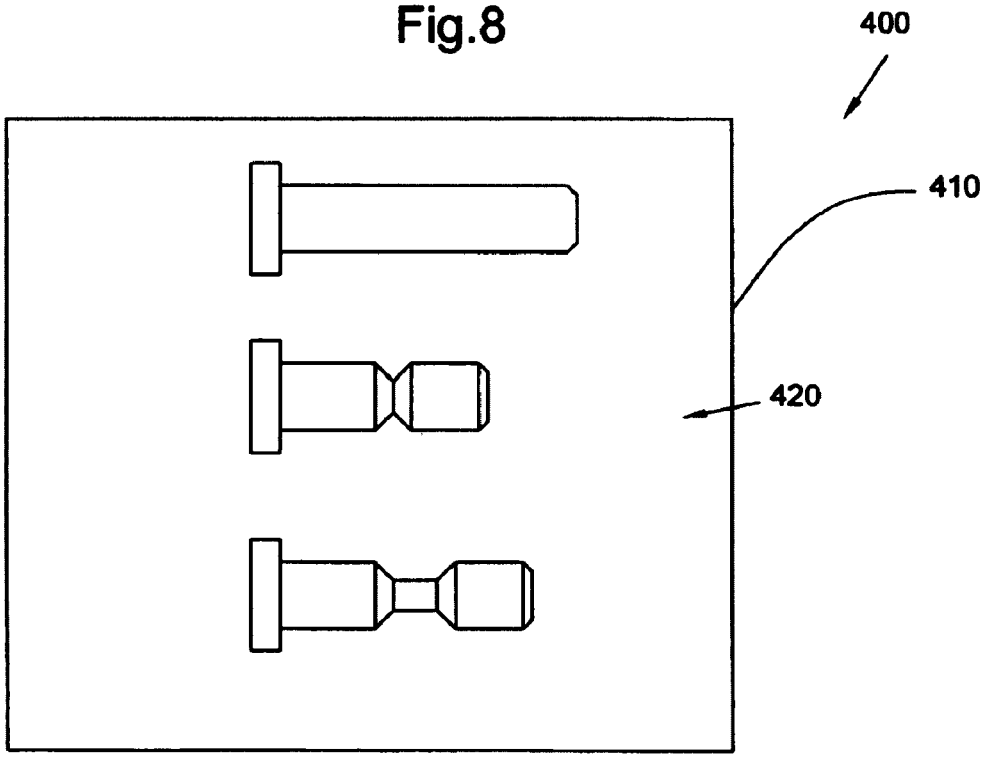
FIG. 8 shows a kit bag having different block members for use with the invention.

FIG. 8 shows a version 400 of a kit bag 410 having different block members 420 for use with the invention. The bag/compartment 410 can house different block members 420 each having different breaking or bending frangible portions so that a user can select a block member that can break/bend at different amounts, such as but not limited to approximately 10 pounds, approximately 15 pounds, approximately 20 pounds, etc.

Although the preferred block member is cylindrical the invention can be practiced with other shapes, such as but not limited to square, rectangular, triangular, hexagonal, oval, and other selected shapes.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A passive safety block for a firearm having a depressible pivotable trigger, comprising:

a frangible member having a longitudinal axis, the depressible pivotable trigger having an upper arm and a lower arm being oriented in an identical plane, and the depressible pivotable trigger having a hole, a portion of the frangible member being positioned inside of the hole of the depressible pivotable trigger so that the longitudinal axis of the frangible member is oriented perpendicular to the plane of the depressible pivotable trigger, the frangible member being positioned for blocking the trigger from being pulled back into a firing position, the frangible member having a portion being bendable or breakable when a selected pressure value of at least approximately 10 pounds has been reached as the depressible pivotable trigger is being pulled back in the firing position.

2. The passive safety block of claim 1, wherein the frangible member includes:

a metal pin.

3. The passive safety block of claim 1, wherein the frangible member includes:

a plastic pin.

4. The passive safety block of claim 1, wherein the frangible member includes:

a metal screw.

5. The passive safety block of claim 1, wherein the frangible member includes:

a plastic screw.

6. The passive safety block of claim 1, wherein the frangible member includes:

a longitudinal plastic member having an indented surface portion along a side wall of the longitudinal plastic member, the longitudinal plastic member being bendable or breakable along the indented surface portion.

7. The passive safety block of claim 1, wherein the frangible member includes:

a longitudinal metal member having an indented surface portion along a side wall of the longitudinal metal member, the longitudinal metal member being bendable or breakable along the indented surface portion.

8. The passive safety block of claim 1, further comprising:

threads in the hole for holding the frangible member inside of the trigger.

9. The passive safety block of claim 1, wherein the frangible member is selected from a kit having at least two frangible members each having threaded sidewalls, where each of the frangible members being breakable upon different selected pressure values.

10. A passive safety block for a firearm having a depressible pivotable trigger, comprising:

a frangible member having a longitudinal axis, the depressible pivotable trigger having an upper arm and a lower arm being oriented in an identical plane, and the depressible pivotable trigger having a hole, a portion of the frangible member being positioned inside of the hole of the depressible pivotable trigger so that the longitudinal axis of the frangible member is oriented perpendicular to the plane of the depressible pivotable trigger, and threads in the hole for holding the frangible member inside of the trigger, the frangible member being positioned for blocking the trigger from being pulled back into a firing position, the frangible member being bendable or breakable when a selected pressure value has been reached as the depressible pivotable trigger is being pulled back in the firing position.

11. A passive safety block for a firearm having a depressible pivotable trigger, comprising:

a frangible member having a longitudinal axis, the depressible pivotable trigger having an upper arm and a lower arm being oriented in an identical plane, and the depressible pivotable trigger having a hole, a portion of the frangible member being positioned inside of the hole of the depressible pivotable trigger so that the longitudinal axis of the frangible member is oriented perpendicular to the plane of the depressible pivotable trigger, the frangible member being positioned for blocking the trigger from being pulled back into a firing position, the frangible member being bendable or breakable when a selected pressure value has been reached as the depressible pivotable trigger is being pulled back in the firing position, and the frangible member is selected from a kit having at least two frangible members each having threaded sidewalls, where each of the frangible members being breakable upon different selected pressure values.

* * * * *